United States Patent [19]

Sugiyama

[11] 4,152,994

[45] May 8, 1979

[54] FRAME POSITIONING DEVICE FOR AUTOMATIC STITCHING APPARATUS

[75] Inventor: Jin Sugiyama, Osaka, Japan

[73] Assignee: UNITECH Engineering Ltd., Osaka, Japan

[21] Appl. No.: 836,900

[22] Filed: Sep. 26, 1977

[30] Foreign Application Priority Data

Sep. 25, 1976 [JP] Japan ..... 51-115258

[51] Int. Cl.[2] ..... D05B 21/00

[52] U.S. Cl. ..... 112/121.12; 318/45; 318/685

[58] Field of Search ..... 112/121.12, 121.15, 112/275, 277; 318/45, 685

[56] References Cited

U.S. PATENT DOCUMENTS

| | | | |
|---|---|---|---|
| 3,268,785 | 8/1966 | Gerber et al. | 318/45 X |
| 3,497,778 | 2/1970 | Gerber | 318/685 |
| 3,752,098 | 8/1973 | Logan et al. | 112/121.12 |
| 3,970,016 | 7/1976 | Yanikoski | 112/121.12 |
| 3,977,337 | 8/1976 | Yanikoski | 112/121.12 |
| 3,982,491 | 9/1976 | Herzer et al. | 112/121.12 |
| 4,003,322 | 1/1977 | Yanikoski | 112/121.12 |
| 4,050,393 | 9/1977 | Welcher et al. | 112/121.12 |

OTHER PUBLICATIONS

Bickford, J. H. *Mechanisms for Intermittent Motion,* N. Y., Industrial Press Inc., 1972, p. 207.

*Primary Examiner*—Werner H. Schroeder
*Assistant Examiner*—Andrew M. Falik
*Attorney, Agent, or Firm*—Wenderoth, Lind & Ponack

[57] ABSTRACT

For an automatic stitching apparatus of a type comprising at least one sewing machine having a stitching needle operable to perform a stitching operation to form an embroidery pattern on a fabric supported on an embroidery frame, a frame positioning device includes a holder for holding the frame in position relative to the stitching needle, X-axis and Y-axis drive mechanisms each including pulse responsive stepping motors mechanically connected to each other to provide an X-axis or Y-axis output drive necessary to move the frame in a predetermined direction to a given coordinate position, and first and second linkage mechanisms for transmitting the X-axis and Y-axis drives, respectively, to the frame holder. The stepping motor for each drive mechanism is connected in such a manner that the associated rotors are angularly offset from each other with respect to the axis of rotation of the rotors.

2 Claims, 13 Drawing Figures

| | A | A' | B | B' | C | C' | D | D' |
|---|---|---|---|---|---|---|---|---|
| 0 | ○ | ○ | ○ | | | | | ○ |
| 1 | ○ | ○ | ○ | | | | | |
| 2 | ○ | ○ | ○ | ○ | | | | |
| 3 | | ○ | ○ | ○ | | | | |
| 4 | | ○ | ○ | ○ | ○ | | | |
| 5 | | | ○ | ○ | ○ | | | |
| 6 | | | ○ | ○ | ○ | ○ | | |
| 7 | | | | ○ | ○ | ○ | | |
| 8 | | | | ○ | ○ | ○ | ○ | |
| 9 | | | | | ○ | ○ | ○ | |
| 10 | | | | | ○ | ○ | ○ | ○ |
| 11 | | | | | | ○ | ○ | ○ |
| 12 | ○ | | | | | ○ | ○ | ○ |
| 13 | ○ | | | | | | ○ | ○ |
| 14 | ○ | ○ | | | | | ○ | ○ |
| 15 | ○ | ○ | | | | | | ○ |

| | A | A' | B | B' | C | C' | D | D' |
|---|---|---|---|---|---|---|---|---|
| 0 | ○ | ○ | ○ | ○ | | | | |
| 1 | | ○ | ○ | ○ | ○ | | | |
| 2 | | | ○ | ○ | ○ | ○ | | |
| 3 | | | | ○ | ○ | ○ | ○ | |
| 4 | | | | | ○ | ○ | ○ | ○ |
| 5 | ○ | | | | | ○ | ○ | ○ |
| 6 | ○ | ○ | | | | | ○ | ○ |
| 7 | ○ | ○ | ○ | | | | | ○ |

FRAME POSITIONING DEVICE FOR AUTOMATIC STITCHING APPARATUS

BACKGROUND OF THE INVENTION

The present invention generally relates to an automatic stitching apparatus for stitching an embroidery pattern on a fabric supported on a tabouret or embroidery frame and, more particularly, to a frame positioning device in the automatic stitching apparatus for moving the tabouret or embroidery frame relative to a stitching needle in a given coordinate direction.

More specifically, the present invention pertains to the frame positioning device wherein a stepping motor assembly is employed for each of two drive mechanisms for respectively moving the embroidery frame in an X-axis direction and in a Y-axis direction perpendicular to the X-axis direction to bring the frame to a predetermined coordinate position.

Japanese Patent Publication No. 42-22489, published on November 2, 1967 in Japan and first filed in the United States of America under U.S. patent applications Ser. Nos. 293,944 and 374,607 of July 10, 1963 and June 12, 1964, respectively, now U.S. Pat. Nos. 3,146,386 and 3,268,785, respectively, discloses a pulse driven positioning system, particularly applicable to an X-Y plotter, which employs stepping motor assmblies for X-axis and Y-axis drive mechanisms.

Although the stepping motor assembly itself may, so far as it is comprised of a plurality of pulse responsive stepping motors wherein, while respective stators remain aligned in phase with each other, the associated rotors are angularly offset at a predetermined angle relative to each other on a power output shaft, be employed in the present invention, it will not meet the following requirements which must be satisfied for the stepping motor assembly to be employed in the present invention.

(1) A high output torque must be available, (2) A power output shaft must be rotated stepwisely over a predetermined angle as small as possible about the longitudinal axis of the shaft.

(3) The stepping motor assembly must be capable of responding to a train of pulses having a frequency greater than the rated maximum frequency of each of the stepping motors constituting the stepping motor assembly.

However, in order for the stepping motors to be rotated without the output torque falling below an acceptable value, the rate of pulses to be applied thereto must be relatively low. On the contrary thereto, if the rate of pulses to be applied to the stepping motors is increased and in order for the stepping motors to be capable of accurately responding to the applied pulses with no substantial delay in operation, it is necessary to cause the stepping motors to operate so as to give a relatively low output torque. This irreconcilability in performance characteristic of the stepping motors, when the latter are applied in the frame positioning device of the present invention wherein a relatively great force is required to move the frames simultaneously to respective coordinate positions, often provides such a problem that the frames cannot readily be moved to the coordinate positions at relatively high speeds.

Furthermore, to the knowledge of the inventor, the stepping motor assembly specifically designed for use in the automatic stitching apparatus is believed to be novel.

SUMMARY OF THE INVENTION

Accordingly, the object of the present invention is to provide a frame positioning device for an automatic stitching apparatus, which is capable of moving embroidery frames at high speeds and with great positional accuracy relative to stitching needles.

Another object of the present invention is to provide a frame positioning device of the type referred to above which comprises stepping motor assemblies each capable of giving a relatively great output torque and accurately operable in response to applied input pulses.

According to the present invention, the automatic stitching apparatus to which the present invention is applicable comprises at least one sewing machine having a stitching needle and rigidly mounted on a worktable, the needle being operable to perform a stitching operation to form an embroidery pattern on a fabric supported on an embroidery frame on the worktable. The embroidery frame is placed on the worktable in alignment with and within an area perpendicular to the needle for movement in a coordinate direction relative to the needle.

For the purpose of moving the frame in the coordinate direction, there is provided in the automatic stitching apparatus of the type referred to above a frame positioning device which comprises means for holding the frame in position relative to the stitching needle on the worktable, an X-axis drive mechanism including a plurality of pulse responsive stepping motors mechanically connected to each other to provide an X-axis output drive, a Y-axis drive mechanism including a plurality of pulse responsive stepping motors mechanically connected to each other to provide a Y-axis output drive, a first linkage mechanism for transmitting the X-axis output drive to the holding means for moving the embroidery frame in the X-axis direction and a second linkage mechanism for transimitting the Y-axis output drive to the holding means for moving the embroidery frame in the Y-axis direction. For operating each of the drive mechanisms, the positioning device of the present invention further comprises an X-axis pulse generating means for applying a train of pulses to the stepping motors of the X-axis drive mechanism and a Y-axis pulse generating means for applying a train of pulses to the stepping motors of the Y-axis drive mechanism. The number of the pulse of the train from any one of the X-axis and Y-axis pulse generating means is proportional to one step of angular movement of the rotors of the stepping motors.

Furthermore, according to the present invention, each of the stepping motors of any one of the X-axis and Y-axis drive mechanisms comprises a stator, a rotor and a plurality of pairs of windings, the windings of each pair being spaced 180° from each other about a power output shaft of the motor. The pairs of the windings are energizable in a step-by-step sequence to urge the associated rotor to move a given angular distance as the energization of the pairs of the windings is changed from any one step to the next succeeding step in the stepwise sequence.

While each of the stepping motors is constructed as hereinbefore described and as well known to those skilled in the art, the stepping motors for each drive mechanism are connected to each other in such a manner that the rotors of the stepping motors are successively angularly offset from each other at an offset angle of 1/n of the angle of spacing between each adjacent two of the pairs of the windings, or of the angle of one step of rotation of the rotor of any one of the stepping motors when the latter are separated from each other, wherein n represents the number of the stepping motors. The trains of pulses respectively applied to the stepping motors of any one of the X-axis and Y-axis drive mechanisms are of a nature that every adjacent m2, in the case of m being an even integer, or (m+1)/2, in the case of m being an odd integer, of the pairs of the windings of each of the stepping motors can be energized to move the associated rotor in the step-by-step sequence, wherein m represents the number of the phases of the windings of each of the stepping motors.

BRIEF DESCRIPTION OF THE DRAWINGS

These and other objects and features of the present invention can readily be understood from the following description taken in conjunction with preferred embodiments thereof with reference to the accompanying drawings, in which.

DETAILED DESCRIPTION OF THE INVENTION

Figure 1:
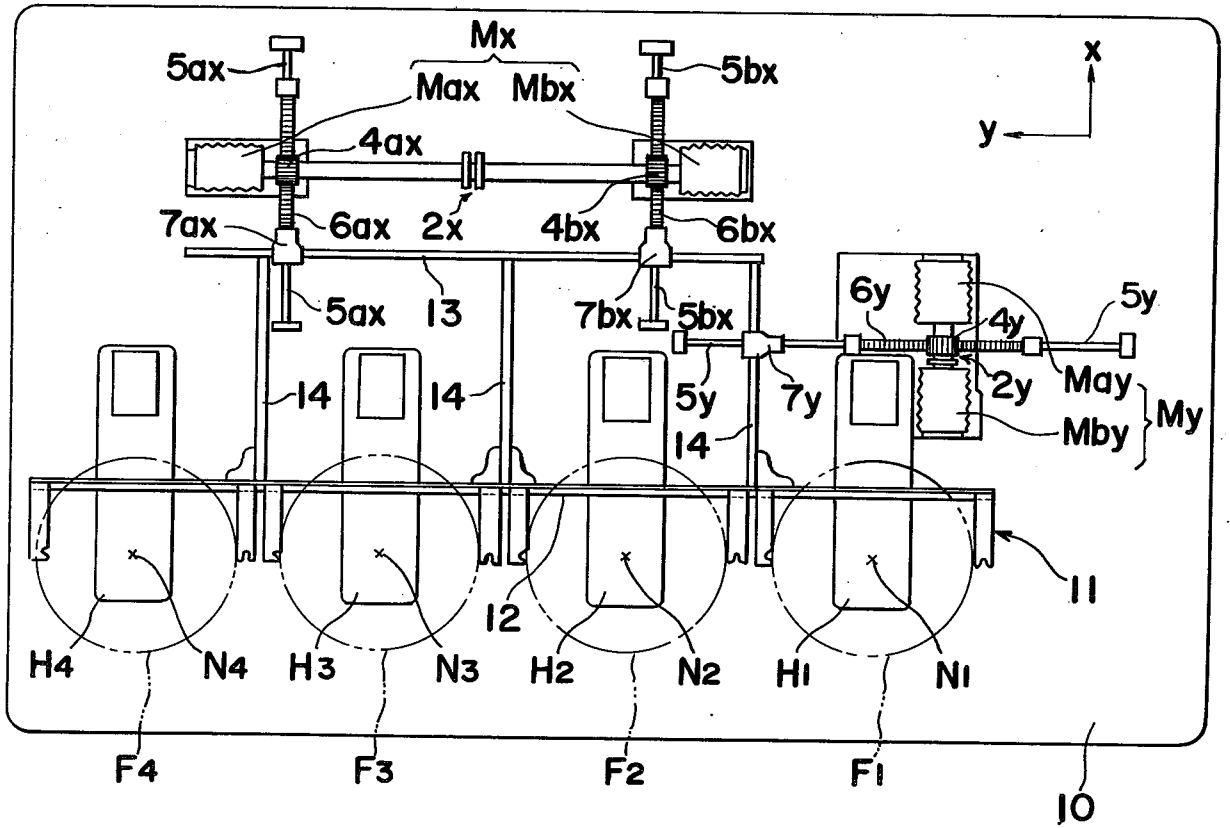
FIG. 1 is a schematic top plan view of an automatic stitching apparatus embodying the present invention.

Before the description of the present invention proceeds, it is to be noted that like parts are designated by like reference numerals throughout the accompanying drawings.

Referring first to FIG. 1, an automatic stitching apparatus having a frame positioning device embodying the present invention comprises one or more, for example, four, sewing machines $H_1$, $H_2$, $H_3$ and $H_4$ of any known construction having respective stitching needles $N_1$, $N_2$, $N_3$ and $N_4$. These sewing machines $H_1$, $H_2$, $H_3$ and $H_4$ are rigidly mounted on a common worktable 10 in side-by-side arrangement and are operable to move the stitching needles $N_1$, $N_2$, $N_3$ and $N_4$ up and down to perform a sewing or stitching operation subject to respective clothes which are supported and/or stretched on tabourets or embroidery frames $F_1$, $F_2$, $F_3$ and $F_4$ of any known construction. These sewing machines may be of a type either driven by their own drive motors or driven by a common drive motor in synchronism with each other, for reciprocally moving the associated needles $N_1$, $N_2$, $N_3$ and $N_4$.

The frame positioning device is utilized to move the embroidery frames $F_1$, $F_2$, $F_3$ and $F_4$ simultaneously relative to the associated stitching needles $N_1$, $N_2$, $N_3$ and $N_4$ and in a given coordinate direction determined by a pattern information representative of a predetermined embroidery pattern to be stitched. To this end, the frame positioning device includes holders 11, carried by a support bar 12 in any known manner, for supporting and clamping the respective embroidery frames $F_1$, $F_2$, $F_3$ and $F_4$ above the worktable 10 and in a common plane perpendicular to the direction of movement of the needles $N_1$, $N_2$, $N_3$ and $N_4$. The frame positioning device further includes an X-axis drive mechanism Mx, composed of a plurality of, for example, two, stepping motors Max and Mbx having their drive shafts coupled to each other by a suitable coupler 2*x*, for moving the support bar 12 in a direction, that is, an X-axis direction, perpendicular to the longitudinal axis of bar 12, and a Y-axis drive mechanism My, similarly composed of a plurality of, for example, two, stepping motors May and Mby having their drive shafts coupled to each other by a suitable coupler 2*y*, for moving the support bar 12 in a direction, that is, a Y-axis direction, parallel to the longitudinal axis of the bar 12 and perpendicular to the X-axis direction.

For transmitting rotation of the drive shafts of the stepping motors Max and Mbx of the X-axis drive mechanism Mx to the support bar 12 to move the latter in the X-axis direction, drive pinions 4*ax* and 4*bx* are rigidly mounted on the drive shafts respectively adjacent the motors Max and Mbx and constantly engaged to rack members 6*ax* and 6*bx*, respectively. Each rack member 6*ax* and 6*bx* is in the form of a hollow shaft, having a rack gear formed on its outer peripheral surface, and the rack members are respectively mounted on guide rails 5*ax* and 5*bx* secured to the worktable 10 at their opposite ends and extending in parallel relation to each other and at right angles to the drive shafts of the stepping motors Max and Mbx. Each of the rack members 6*ax* and 6*bx* has one end rigidly connected to a substantially T-shaped joint member 7*ax* or 7*bx* which is movably mounted on a Y-axis bar 13 extending at right angles to the longitudinal axis of the rack members 6*ax* and 6*bx*. It is to be noted that each of the T-shaped joint members 7*ax* and 7*bx* is so designed as to allow the Y-axis bar 13 to move in the Y-axis direction independently of the movement of the rack members 6*ax* and 6*bx* and as to allow the Y-axis bar 13 to be laterally moved in the X-axis direction together with the rack members 6*ax* and 6*bx*. The Y-axis bar 13 is in turn connected to the holder support bar 12 by means of a plurality of, for example, three, connecting bars 14.

For transmitting rotation of the drive shafts of the stepping motors May and Mby of the Y-axis drive mechanism My to the support bar 12 to move the latter in the Y-axis direction, a drive pinion 4*y* is rigidly mounted on one of the drive shafts of the stepping motors May and Mby and constantly engaged to a rack member 6y. This rack member 6y is similar in construction to any one of the rack members 6ax and 6bx and is, therefore, movable on a guide rail 5y having its opposed ends secured to the worktable 10 and extending in parallel to the longitudinal axis of the holder support bar 12 and at right angles to the drive shafts of the stepping motors May and Mby. The rack member 6y has one end rigidly connected to a substantially T-shaped joint member 7y which is movably mounted on one of the connecting bars 14 which extends between the sewing machines $H_1$ and $H_2$ at right angles to the Y-axis bar 13. The T-shaped joint member 7y is similar in construction to any one of the T-shaped joint members 7ax and 7bx and, therefore, the connecting bar 14 can move in the X-axis direction independently of the movement of the rack member 6y, but can be moved in the Y-axis direction together with the rack member 6y.

It is to be noted that, in FIG. 1, the stepping motors Max and Mbx are depicted as spaced from each other by distance greater than the distance between the stepping motors May and Mby and, therefore, the X-axis drive mechanism Mx is shown to include the two drive pinions 4ax and 4bx and the corresponding rack members 6ax and 6bx. This is because the sewing machines $H_1$, $H_2$, $H_3$ and $H_4$ are arranged on the worktable 10 side-by-side in a direction parallel to the Y-axis direction. However, depending upon the design of the automatic stitching apparatus, the number of combinations of a drive gear and a rack member associated with the stepping motors Max and Mbx may be one or more than two.

In the construction so far described, it is clear that rotation of the drive shafts of the stepping motors Max and Mbx results in the movement of the holder support bar 12 in the X-axis direction and rotation of the drive shafts of the stepping motors May and Mby results in the movement of the holder support 12 in the Y-axis direction. Furthermore, it is clear that, when the X-axis and Y-axis drive mechanisms Mx and My are simultaneously operated, the embroidery frames $F_1$, $F_2$, $F_3$ and $F_4$ are simultaneously moved in a given coordinate direction to a predetermined position relative to the associated stitching needles $N_1$, $N_2$, $N_3$ and $N_4$.

Figure 2:
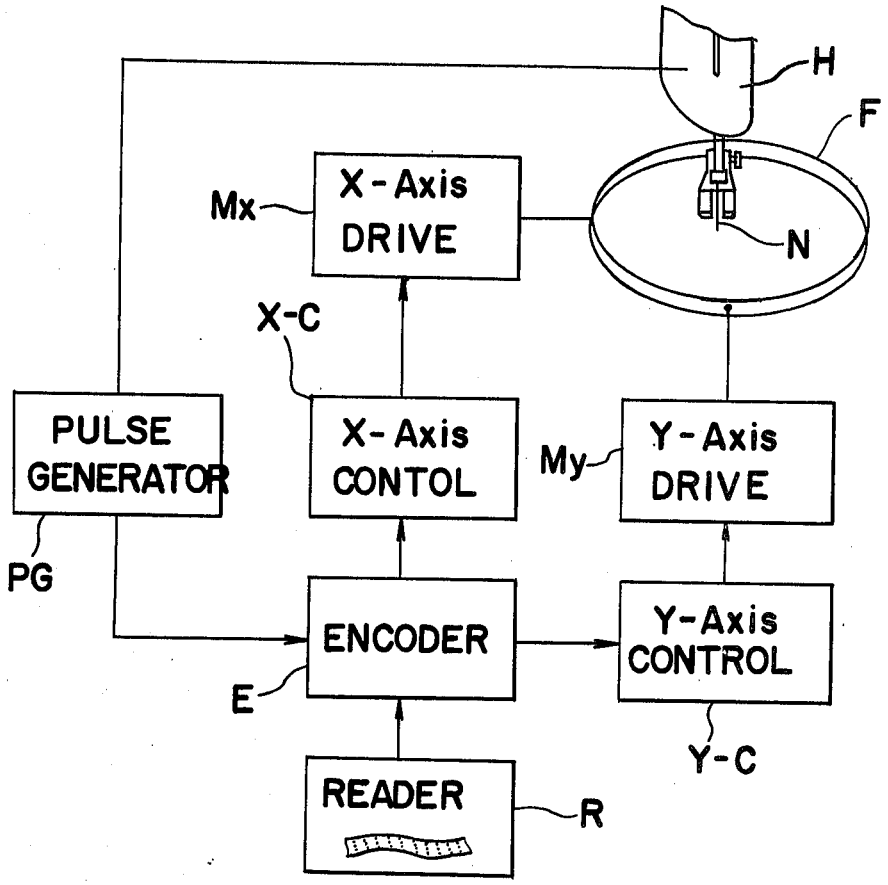
FIG. 2 is a block diagram of a circuit for moving an embroidery frame in a coordinate direction.

In FIG. 2, there is illustrated an electric circuit block diagram for moving the embroidery frames $F_1$, $F_2$, $F_3$ and $F_4$ in the given coordinate direction relative to the associated stitching needles $N_1$, $N_2$, $N_3$ and $N_4$. It is to be noted that, for the sake of brevity, only one of the sewing machines and its associated embroidery frame are shown by H and F in FIG. 2, respectively.

Referring now to FIG. 2, the circuitry comprises a reader unit R which reads a pattern information representative of a predetermined embroidery pattern to be stitched out from a punched tape or card. The pattern information read by the reader unit R is fed to an encoder unit E which is so designed as to discriminate the pattern information into pattern signals respectively associated with the X-axis and Y-axis drives and as to supply to an X-axis control unit X-C a train of pulses proportional to a predetermined displacement of the frame F in the X-axis direction and to a Y-axis control unit Y-C another train of pulses proportional to a predetermined displacement of the frame F in the Y-axis direction. It is to be noted that, depending upon the contents of the pattern information, the number of the pulses of the train fed from the encoder E to the control unit X-C and those of the train fed from the encoder E to the control unit Y-C may differ from each other or may be equal to each other and that these trains of pulses are generated from the encoder E only during a period in which a train of pulses are supplied thereto from a pulse generator, the operation of which is synchronized with the speed of movement of the stitching needle N. More specifically, the pulse generator PG is so associated with the sewing machine that only during a period from the time at which the stitching needle N disengages from the fabric on the frame F to the time at which the same stitching needle N is about to engage, or pierce, through the fabric on the frame F does the pulse generator PG generate such train of pulses, the duration of each pulse of the train from the pulse generator PG being variable according to the speed of movement of the stitching needle N. Therefore, it is clear that the movement of the embroidery frame F to a predetermined coordinate position on the fabric on the frame F is effected only during the above described period.

It is to be noted that the pulse generator PG may be of any known construction. For example, the pulse generator PG may be of a construction comprising a perforated rotary disc so associated with the sewing machine H that one rotation of the rotary disc corresponds to one reciprocal movement of the stitching needle N, a light emitting element positioned on one side of the rotary disc and a light receiving element positioned on the other side of the rotary disc. With this type of pulse generator, it will readily be seen that the light receiving element, upon receipt of rays of light passing through a plurality of perforations in the rotary disc from the light emitting element generates a train of pulse, corresponding to a pulsating beam of light detected thereby, during rotation of the rotary disc in synchronism with the speed of movement of the needle N.

While the details of the control units X-C and Y-C, which are of the same construction so far as the number of the stepping motors of the X-axis drive mechanism and that of the Y-axis drive mechanism are equal to each other such as shown in FIG. 1, will be described later, the control units X-C and Y-C supply the X-axis and Y-axis drive mechanisms Mx and My, respectively, with individual command signals, in the form of a train of pulses proportional to a desired displacement of the frame F in the X-axis and Y-axis directions, in response to the pulses of the respective trains fed thereto from the encoder unit E in accordance with the pattern information.

With the command signals fed from the respective control units X-C and Y-C, the X-axis and Y-axis drive mechanisms Mx and My are operated to move the frame F to a predetermined coordinate position relative to the stitching needle N.

The details of the stepping motors of any one of the X-axis and Y-axis drive mechanisms Mx and My will now be described with particular reference to FIG. 3. However, it is to be noted that, since the stepping motors of the X-axis drive mechanism Mx and those of the Y-axis drive mechanism My are of the same construction, reference will now be made only to the stepping motors Max and Mbx of the X-axis drive mechanism Mx for the sake of brevity.

Figure 3:
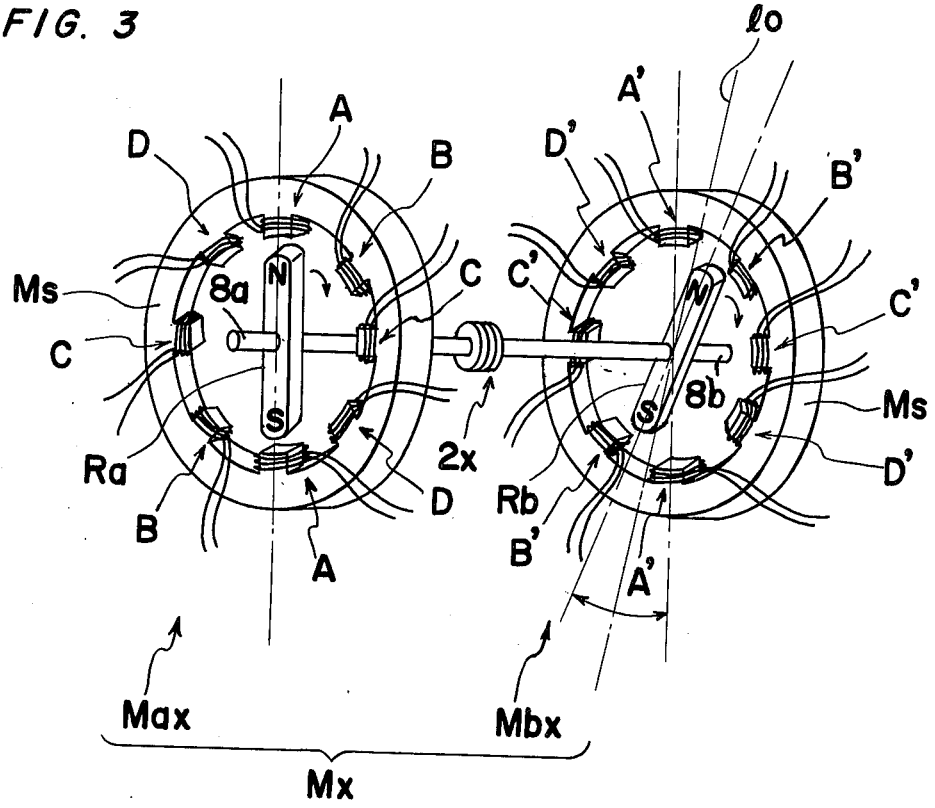
FIG. 3 is a schematic perspective view showing the manner in which two stepping motors are operatively coupled to each other according to the present invention.

Referring now to FIG. 3, each of the stepping motors Max and Mbx is schematically shown to comprise a substantially ring-shaped stator Ms including a plurality of pairs of salient poles equally spaced from each other in a circumferential direction of the ring-shaped stator Ms, the salient poles of each pair being spaced 180° from each other. The stator Ms has associated therewith windings each received on a respective one of the salient poles. So far as illustrated in FIG. 3, the number of pairs of the salient poles is four and the salient poles of these pairs are spaced 45° from each other with repect to the longitudinal axis of the drive shaft 8*a* or 8*b*. The four pairs of the windings, one on each salient pole of the stator Ms of the stepping motor Max, are respectively designated by A, B, C and D while those of the stator Ms of the stepping motor Mbx are respectively designated by A', B', C' and D'. Each of the stepping motors Max and Mbx further comprises a rotor Ra or Rb rigidly mounted on the drive shaft 8*a* or 8*b* and is permanently magnetized so as to have north and south poles as shown by the letters N and S respectively.

So far as one of the stepping motors, for example, the stepping motor Max, is involved, it will readily be seen that, by properly changing the state of energization of the pairs of the windings in one or another of two definite sequential patterns, the rotor Ra may be made to move, or at least be urged to move, in either a clockwise or counterclockwise direction relative to the stator Ms. The energization of the four pairs of the windings on the salient poles of the stator Ms is by direct current and, depending on the direction of flow of this current in each winding, the associated poles of each pair of the stator Ms will be magnetized so as to have their end faces provide either north and south magnetic poles or south and north magnetic poles. In any event, the construction of the individual stepping motors Max and Mbx is well known to those skilled in the art.

However, in accordance with the teachings of the present invention, as best shown in FIG. 3, the drive shafts 8*a* and 8*b* of the stepping motors Max and Mbx are connected to each other by the coupler 2*x* in alignment with each other in such a manner that the rotors Ra and Rb of the respective stepping motors Max and Mbx are angularly offset from each other on their supporting drive shafts 8*a* and 8*b* while the stators Ms of the respective stepping motors Max and Mbx are aligned in phase with each other. The offset angle, which is an angle formed by offsetting the rotors from each other on their supporting drive shafts which are connected together, is equal to 1/n of the angle of spacing between each adjacent two of the salient poles of any one of the stators Ms, wherein n represents the number of the stepping motors employed which is an integer greater than 1. In the illustrated embodiment, since the number of the stepping motors for each drive mechanism Mx or My is two and the angle of spacing between each adjacent two of the salient poles is 45° as described above, the offset angle is 22.5°. Therefore, so far as the illustrated example is involved, as shown in FIG. 3, when and so long as the rotor Ra is held in alignment with the pair of the salient poles A spaced 180° from each other, the rotor Rb is held in position with its north and south poles 22.5° angularly spaced clockwise from the pair of the salient poles A' which are also spaced 180° from each other.

Figure 4:
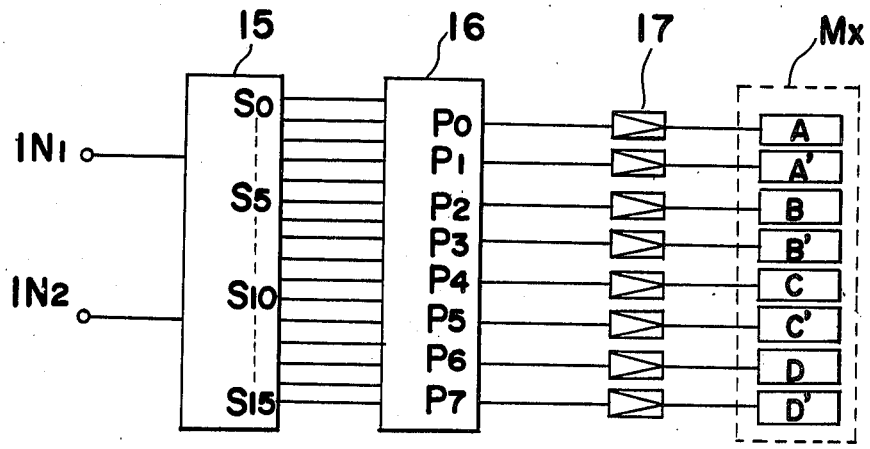
FIG. 4 is a schematic block diagram showing a control unit in one embodiment of the present invention.

The X-axis and Y-axis control units X-C and Y-C for the X-axis and Y-axis drive mechanisms Mx and My are of the same construction as hereinbefore described and, therefore, the details of only one of the control units, for example, the control unit X-C will now be described with particular reference to FIG. 4 or FIG. 5. However, it is to be noted that the control unit shown in FIG. 4 is applicable where any one of the rotors Ra and Rb of the stepping motors of the construction shown in FIG. 3 is desired to be rotated at each step angle of 11.25° per pulse applied, which step angle is one-fourth of the angle of spacing between each adjacent two of the salient poles of any one of the stators Ms. In other words, where the stepping motors are desired to be rotated in progressive 11.25° steps, the control unit of a construction shown in FIG. 4 can be utilized. On the other hand, where the stepping motors are desired to be rotated in progressive 22.5° steps, the control unit of a construction shown in FIG. 5 can be utilized.

Referring now to FIG. 4, the control unit may include an up-down counter 15 having a pair of input terminals $IN_1$ and $IN_2$ to which a pulse for rotating the stepping motors Max and Mbx in one direction and an inverted pulse for rotating the stepping motors Max and Mbx in the opposite direction are respectively applied one at a time, and a pulse distributor 16 capable of generating pulse signals, in response to an input signal fed from the up-down counter 15, in a predetermined programmed set in the pulse distributor 16 as will be described later, and having output terminals $P_0$, $P_1$. . . $P_6$ and $P_7$ which are respectively electrically connected to the pairs of the windings A, A', B, B', C, C', D and D' in the drive mechanism Mx through associated power amplifiers generally indicated by 17.

Figure 6:
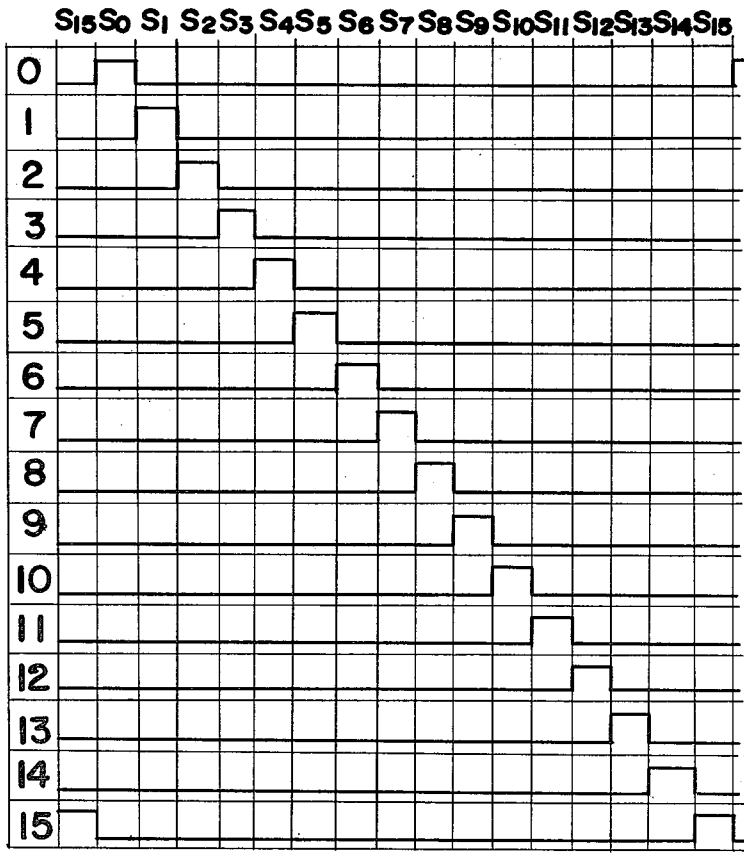
FIG. 6 is a diagram showing waveforms of output pulses emerging from an up-down counter employed in the control unit of FIG. 4.

The up-down counter 15 has output terminals $S_0$, $S_1$. . . $S_{14}$ and $S_{15}$ from which respective trains of pulses are generated in a predetermined sequence as shown in FIG. 6. These trains of pulses from the up-down counter 15 are sequentially supplied to the pulse distributor 16 having the output terminals $P_0$, $P_1$ . . . $P_6$ and $P_7$ from which respective energizing pulses as shown in FIG. 7 are generated in a predetermined sequence programmed in the pulse distributor 16. the energizing pulses from the distributor 16 are in turn fed through the power amplifiers 17 to one or more pairs of the windings A, B, C, D, A', B', C' and D' to energize the latter.

Figure 7:
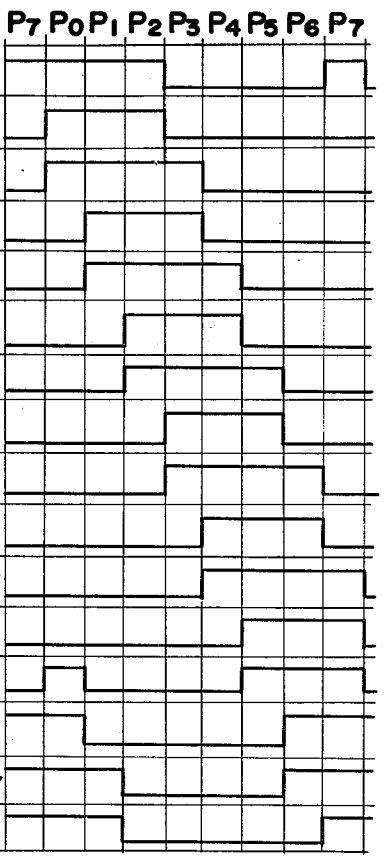
FIG. 7 is a diagram showing waveform of output pulses emerging from a pulse distributor employed in the control unit of FIG. 4.

More specifically, assuming that a pulse is supplied to the distributor 16 from the output terminal $S_0$ of the up-down counter 15 during the step 0, energizing pulses are respectively generated from the output terminals $P_0$, $P_1$, $P_2$ and $P_7$ of the distributor 16 as shown in FIG. 7 and, with these energizing pulses so generated and subsequently amplified in power by the associated amplifiers 17, the pairs of the windings A, A', B and D' are simultaneously energized. On the other hand, during the step 1, the distributor 16 is triggered by the pulse, which has been fed from the output terminal $S_1$ of the counter 15, to generate energizing pulses from the output terminals $P_0$, $P_1$ and $P_2$ and, therefore, the pairs of the windings A, A' and B are simultaneously energized.

Figures 8, 10:
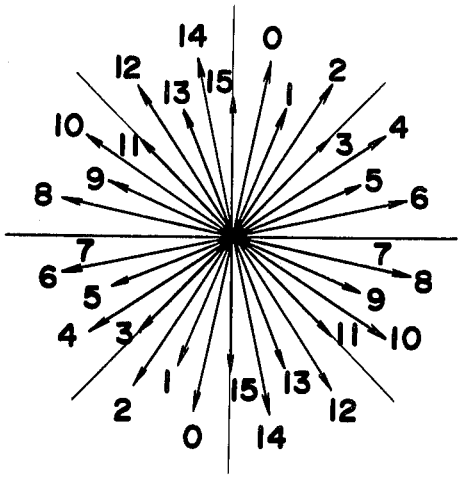
FIG. 8 is a chart showing a programmed pattern of states of energization of the motor windings to which the pulses shown in FIG. 7 are applied.
FIG. 10 is a diagram showing stepwise rotation of any one of the drive mechanisms relative to the output torque.

From FIG. 8, it can readily be understood that the windings of any pair of the motors Max and Mbx are sequentially energized according to the pattern of progressive steps shown by the circles. Furthermore, from FIG. 8, it is clear that, during the step 2, the pairs of the windings A, A', B and B' are simultaneously energized and, during the step 3, the pairs of the windings A', B and B' are simultaneously energized. In other words, the state of energization of the windings is such that, when the rotors Ra and Rb are to be rotated from an even-numbered step to an odd-numbered step, the pairs of the windings, which are respectively positioned on the trailing side with respect to the direction of rotation of the rotors Ra and Rb are deenergized while, when the rotors Ra and Rb are to be rotated from the odd-numbered step to the even-numbered step, the pairs of the windings which are respectively positioned on the leading side with respect to the direction of rotation of the rotors Ra and Rb are simultaneously energized. As described above, three pairs of the windings of the stators Ms and four pairs of the windings of the same stators are alternately energized, thereby stepwisely rotating the rotors Ra and Rb simultaneously in the direction as indicated by the arrow in FIG. 3. This method of energization of the windings of the stepping motors Max and Mbx is hereinafter referred to as a 3–4 phase energization method.

In this way, by sequentially changing the states of energization of the pairs of the windings, the rotors Ra and Rb can be rotated in progressive 11.25° steps, sixteen steps being required to produce half the full revolution of any one of the rotors Ra and Rb.

The nature of the operation of the drive mechanism Mx whose windings are energized according to the 3–4 phase energization method and as described with reference to FIGS. 7 and 8, can be best understood from FIG. 9. which shows vector diagrams showing the relationship between the direction of force acting on any one of the rotors Ra and Rb and the magnitude of such force and also the relationship between the direction of composite force and the magnitude of such composite force. In the vector diagrams of FIG. 9, the force acting on any one of the rotors Ra and Rb, which is produced upon energization of one pair of the windings associated with such one of the rotors Ra and Rb is expressed as having a value of 1.

Figure 9:
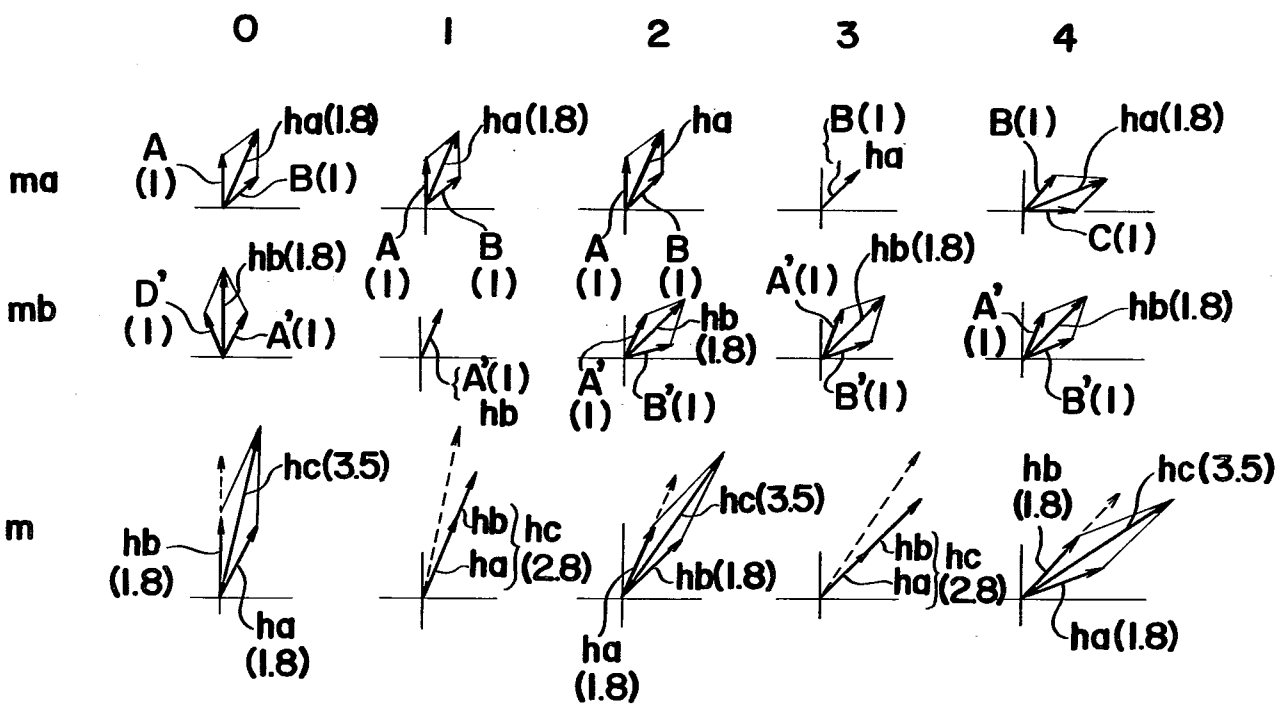
FIG. 9 is a diagram showing an output drive from any one of the drive mechanisms in vector representation.

Referring to FIG. 9, the vector diagrams in a row identified by ma represent vectors acting on the rotor Ra when the pairs of the windings A, B, C and D are sequentially energized according to the 1–2 phase energization method in progressive steps 0, 1, 2, 3 and 4 while the vector diagrams in a row identified by mb represent vectors acting on the rotor Rb when the pairs of the windings A′, B′, C′ and D′ are sequentially energized according to the 1–2 phase energization method in the same progressive steps. The vector diagrams in a row identified by m represent the net results obtained by the addition of the vectors ha and hb in the vector diagrams in the rows ma and mb. It will be seen that the composite vector hc in each vector diagram in the row m is aligned with an imaginary line lo (FIG. 3) passing the axis of rotation of the rotors Ra and Rb and at an angle half the offset angle of 22.5°. It is to be noted that, in the vector diagrams in the row m, the arrow-headed broken line represents the position of the composite vector hc, shown by the solid line, which was occupied during the preceding step. If the composite vectors hc in respective sixteen progressive steps are collectively depicted on the same plane, it is clear that the composite vectors vary as shown in FIG. 10 during stepwise rotation of the rotors Ra and Rb. Moreover, from FIG. 10, it is also clear that the rotors Ra and Rb are simultaneously rotated step by step every 11.25° per pulse applied, and that the torque of the drive shafts 8*a* and 8*b* connected to each other will alternately take values of 2.8 and 3.5, with reference to the base value of 1 as discussed above. So far as the minimum torque available in the drive mechanism of the construction shown in FIG. 3 is involved, it is higher than the minimum torque available in the drive mechanism wherein the drive shafts of the stepping motors are coupled to each other without the rotors being offset from each other.

The foregoing description made with reference to any one of FIGS. 3 to 10 and in connection with the drive mechanism Mx can equally be applicable to the drive mechanism My.

Referring back to FIG. 1, assuming that the stepping motors Max, Mbx and May, Mby of the respective drive mechanisms Mx and My are energized in the manner shown in the step O in FIG. 8, that each of the drive pinions 4*ax*, 4*bx* and 4*y* is set to engage the associated rack member 6*ax*, 6*bx* or 6*y* at a position intermediate of the length of such associated rack member, that each of the embroidery frames $F_1$, $F_2$, $F_3$ and $F_4$ is at this time positioned at the zero point in the plane of coordinates, and that each of the embroidery frames $F_1$, $F_2$, $F_3$ and $F_4$ is desired to be displaced, for example, $5\times\sqrt{2}$ cm in a coordinate direction at an angle of −45° relative to the X-axis, the positioning device of the present invention is operated in a manner as follows. That is, a train of energizing pulses, the number of which is proportional to a 5 cm displacement of the embroidery frames in the X-axis direction is applied to the drive mechanism Mx so that the pairs of the windings of the stepping motors Max and MMbx can be energized in six progressive steps 0, 1 2, 3, 4, and 5 as shown in FIG. 8, while another train of energizing pulses, the number of which is proportional to the −5 cm displacement of the embroidery frames in the Y-axis direction is applied to the drive mechanism My so that the pairs of the windings of the stepping motors May and Mby can be energized in six progressive steps O, 15, 14, 13, 12 and 11 in a reverse sequence as shown in FIG. 8. By so doing, it is clear that each of the embroidery frames $F_1$, $F_2$, $F_3$ and $F_4$ can be moved 5 cm in the X-axis direction towards the upper portion of FIG. 1 and also 5 cm in the Y-axis direction towards the right of FIG. 1, thereby arriving at the given coordinate position spaced a distance of $5\times\sqrt{2}$ cm from the zero point or original position.

As can readily be seen from FIG. 8, since only one pair of the windings of the stepping motors of any one of the drive mechanisms Mx and My vary in their state of energization during each step of rotation of the rotors Ra and Rb, the stepping motors assembled in the manner shown in FIG. 3 can accept input pulses at relatively low rates and, therefore, have a high pulse responsivity. Accordingly, the embroidery frames $F_1$, $F_2$, $F_3$ and $F_4$ can readily be displaced to any desired coordinate position in response to variation of the speed of movement of the stitching needles $N_1$, $N_2$, $N_3$ and $N_4$.

Hereinafter, a convenient method of connecting the stepping motors of any one of the drive mechanisms Mx and My will now be described. Since the individual stepping motors Max and Mbx or May and Mby have their own motor housings and only their drive shafts 8*a* and 8*b* extend outwards from the respective housings, connection of these motors with the rotors Ra and Rb offset at a predetermined angle, that is, 22.5° from each other can hardly be performed with no difficulty. Therefore, the convenient method is to connect the drive shafts 8*a* and 8*b* to each other by the use of the coupler 2*x* or 2*y* while the separate stepping motors are energized in a predetermined manner according to the pattern of states of energization shown in FIG. 9. For example, it is recommended to connect the drive shafts 8*a* and 8*b* while in the stepping motor Max or May only the pair of the windings A are energized to let the rotor Ra align with the salient poles having such windings of the pair A on one hand and, in the stepping motor Mbx or Mby, two pairs of the windings A′ and B′ are simultaneously energized to let the rotor Rb offset 22.5° clockwise (as viewed in FIG. 3) from the salient poles having the windings of the pair A' on the other hand.

Where the stepping motors, coupled together, of any one of the drive mechanisms Mx and My are desired to be stepwisely rotated every 22.5°, the circuit shown in FIG. 5 may be used, reference to which will now be made.

Figure 5:
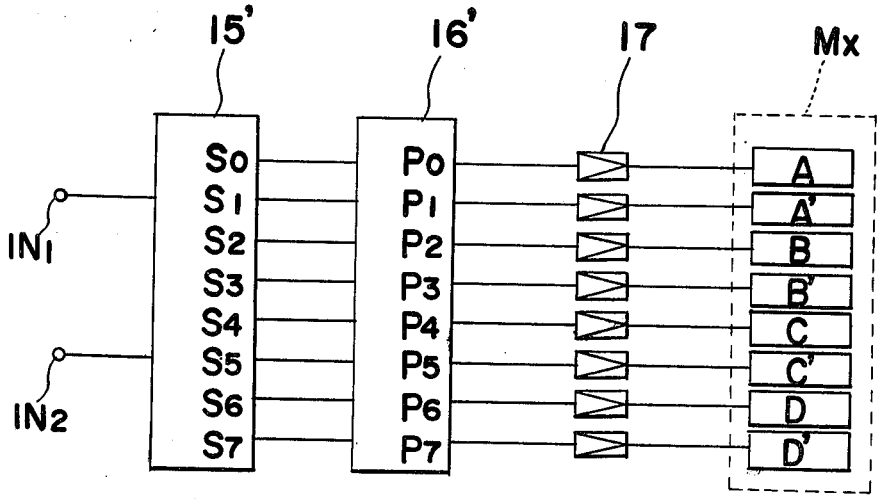
FIG. 5 is a diagram similar to FIG. 4, showing a modified control unit.
Figures 11, 13:
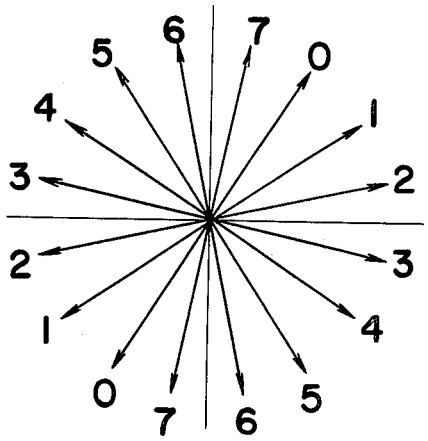
FIG. 11 is a diagram similar to FIG. 8, showing the states of energization occurring when the pulses from the pulse distributor shown in FIG. 5 are applied.
FIG. 13 is a diagram similar to FIG. 10, but associated with the vector representation shown in FIG. 12.
Figure 12:
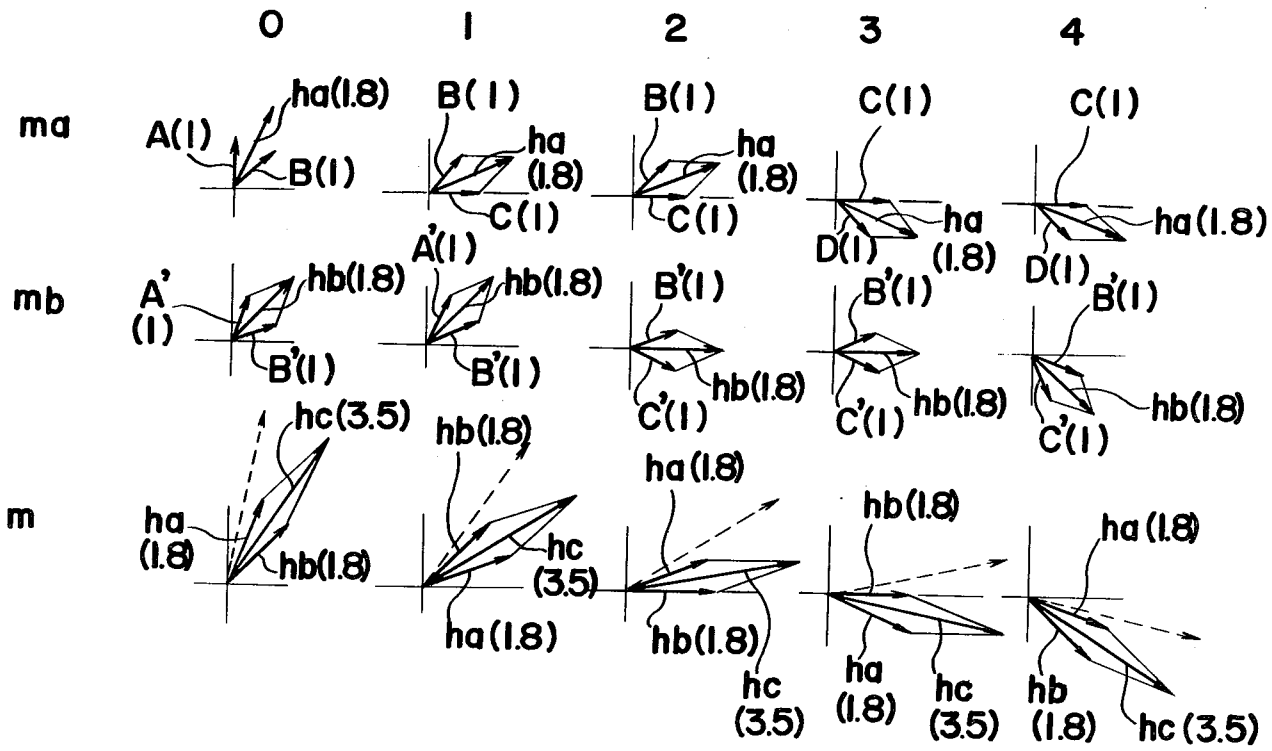
FIG. 12 is a diagram similar to FIG. 9, but applicable to the circuit shown in FIG. 5.

The circuit shown in FIG. 5 differs from that shown in FIG. 4 in that the up-down counter 15' has eight output terminals $S_0$, $S_1 \ldots S_6$ and $S_7$ and in that the pulse distributor 16' is programmed accordingly to generate trains of energizing pulses one at a time according to the pattern of states of energization shown in FIG. 11. This is because the number of progressive 22.5° steps of simultaneous rotation of the rotors Ra and Rb is required to be eight to complete half the full revolution. From FIG. 11, it will readily be seen that every two adjacent pairs of the windings of each of the stepping motors of any one of the drive mechanisms Mx and My are sequentially energized to cause the rotors Ra and Rb to rotate in progressive 22.5° steps. The relationship between the torque and the direction of force in the stepping motors of any one of the drive mechanisms Mx and My is shown in vector representation in FIG. 12, and the pattern of stepwise rotation of the same is shown in FIG. 13.

In the foregoing description, it has been described by way of example that two stepping motors are employed for each drive mechanism Mx or My, that is, $n=2$, and that the angle of spacing between each adjacent two of the salient poles is 45°. However, the present invention is not limited to the above described example, but more than two stepping motors for each drive mechanism Mx or My may be employed and, moreover, each of the stepping motors of any one of the drive mechanisms, irrespective of the number of the stepping motors, may have a number m of pairs of windings.

Furthermore, the stepping motors may not be always connected in the manner shown in FIG. 3 and described above, but may be connected in such a manner that, while the rotors Ra and Rb are aligned in phase with each other, the respective stators Ms are offset from each other at the predetermined offset angle. Moreover, although not shown, the individual drive shafts 8*a* and 8*b* may be replaced by a single drive shaft and/or the stators and the associated rotors may be mounted inside of a common housing.

Accordingly, such changes and modifications are, unless they depart from the true scope of the present invention, to be construed as included within the scope of the present invention.

What is claimed is:

1. In an automatic stitching apparatus of a type which comprises at least one sewing machine having a stitching needle operable to form an embroidery pattern on a fabric; a worktable for the support of the sewing machine thereon; an embroidery frame for the support of the fabric thereon and adapted to be positioned on said worktable with its plane perpendicular to and in alignment with the direction of movement of said stitching needle; means for holding said frame relative to said stitching needle on said worktable for movement in a predetermined coordinate direction; an X-axis drive mechanism including a plurality of pulse responsive stepping motors mechanically connected to each other to provide an X-axis output drive, each of said stepping motors comprising a circular stator having a plurality of circumferentially angularly spaced poles, a rotor and a plurality of pairs of windings on said pairs of poles and which are energizable in a step-by-step sequence to urge said rotor to move a given angular distance as the energization of said pairs of windings is changed from any one step to the next successive step in said sequence; a Y-axis drive mechanism including a plurality of pulse responsive stepping motors mechanically connected to each other to provide a Y-axis output drive, each of said stepping motors comprising a circular stator having a plurality of circumferentially angularly spaced poles, a rotor and a plurality of pairs of windings on said pairs of poles and which are energizable in a step-by-step sequence to urge said rotor to move a given angular distance as the energization of said pairs of windings is changed from any one step to the next successive step in said sequence; first linkage mechanism means for transmitting the output of said X-axis drive mechanism to said holding means for moving said frame in an X-axis direction; second linkage mechanism means for transmitting the output of said Y-axis drive mechanism to said holding means for moving said frame in a Y-axis direction perpendicular to said X-axis direction; and electric means for applyng a train of pulses to said stepping motors of any one of said X-axis and Y-axis drive mechanisms for affecting angular stepwise movement of the respective said rotors thereof; the improvement wherein:

the respective said rotors of said stepping motors of each of said X-axis and Y-axis drive mechanisms are angularly offset from each other with respect to the axis of rotation thereof at an offset angle of 1/n of the angle of spacing between each adjacent tow of said poles of the respective said stator, wherein n is an integer greater than one and represents the number of said stepping motors for each drive mechanism; and said pulse applying electric means comprises means for applying trains of pulses successively to every adjacent m/2, in the case of m being an even integer, and (m+1)/2, in the case of m being an odd integer, of said pairs of windings of each of said stepping motors, wherein m represents the number of the phases of said windings of each of said stepping motors.

2. The improvement claimed in claim 1, wherein the pulse applying means includes an up-down counter and pulse distributor means for generating said trains of pulses in response to an output signal from said up-down counter.

* * * * *